United States Patent [19]

Lawrie

[11] Patent Number: 5,050,515

[45] Date of Patent: Sep. 24, 1991

[54] PRESSER FOOT RETAINER SYSTEM FOR SEWING MACHINE

[75] Inventor: George Lawrie, Mississeuga, Canada

[73] Assignee: SSMC Inc., Edison, N.J.

[21] Appl. No.: 560,930

[22] Filed: Jul. 31, 1990

[51] Int. Cl.[5] ..... D05B 29/08; D05B 29/12

[52] U.S. Cl. ..... 112/240; 112/235

[58] Field of Search ..... 112/235, 240, 151

[56] References Cited

U.S. PATENT DOCUMENTS

| | | | |
|---|---|---|---|
| 2,298,296 | 10/1942 | Ingwer | 112/235 |
| 3,877,404 | 4/1975 | Oda | 112/240 |
| 4,183,311 | 1/1980 | Knowles | 112/235 |
| 4,492,173 | 1/1985 | Hirose | 112/240 |

*Primary Examiner*—Werner H. Schroeder
*Assistant Examiner*—Sullivan C. Prak
*Attorney, Agent, or Firm*—Theodore Jay

[57] ABSTRACT

A presser foot retainer system for use in a sewing machine which utilizes a presser foot device including an elongated generally horizontal foot, a horizontal cross pin positioned above the foot and extending in a direction generally at right angles to the direction of elongation of the foot, and a connector connected both to the pin and the foot to support the pin in said position. A presser bar has a slot in the lower end of the bar which extends generally parallel to the pin. The pin is detachably engageable in the slot to detachably secure the device to the bar.

6 Claims, 4 Drawing Sheets

PRESSER FOOT RETAINER SYSTEM FOR SEWING MACHINE

BACKGROUND OF THE INVENTION

A sewing machine is usually provided with a presser foot which cooperates with a feed dog disposed therebelow to enable feed material disposed between the presser foot and the feed dog to be bed underneath the sewing machine needle to be sewn.

The presser foot is secured to a presser bar. Since the presser foot can assume various shapes and sizes, the presser bar and the presser foot are designed in such manner that the foot can be detachably secured to the bar and can be changed or replaced as desired. To this end, the foot is conventionally provided with an attachment or shank which is securable to the bar by a knurled thumb screw. This arrangement is relatively cumbersome and sometimes difficult to use. Moreover the screw sometimes can become loose without knowledge of the operator and the quality of the sewing operation can deteriorate.

The present invention is directed toward a new and improved presser foot retainer system wherein the presser foot can be quickly and easily installed in and removed from the presser bar without using screws of any type and wherein the foot is held securely in position in the pressure bar and cannot be loosed accidentally, thus obviating the risk of impairing the quality of the sewing operation.

SUMMARY OF THE INVENTION

Accordingly, it is an object of the present invention to provide a new and improved presser foot retainer system for use in a sewing machine which eliminates the need for screws of any kind and wherein the foot is held securely in position in the pressure bar and cannot be loosened accidentally.

Another object is to provide a new and improved presser foot retainer system of the character indicated wherein the presser foot can be quickly and easily secured to or removed from the presser bar by detachably snap fitting a horizontal cross pin secured to the foot into a suitable slot; in the presser bar.

These and other objects and advantages of this invention will either be explained or will become apparent hereinafter.

In accordance with the principles of this invention, the presser foot retainer system employs a presser foot device which includes an elongated generally horizontal presser foot, a horizontal cross pin positioned above the foot and extending in a direction generally at right angles to the direction of elongation of the foot, and means connected to the pin and the foot to support the pin in position above the foot.

Means disposed at the lower end of a presser bar cooperates with a slot in the lower end of the bar which extends generally parallel to the pin. The pin is detachably engagable in the slot to detachably secure the device to the bar. In a preferred form of the invention, the means exerts a force against the pin when in the slot to hold the pin securedly in position.

The lower end of the bar also contains a recess disposed above the slot. The means can include: a compression spring, which is disposed in the recess; a plate which is slidable along the bar past the recess between a raised position at which one side of the slot is exposed and a lowered position at which the exposed side of the slot is covered; a hollow sleeve which is open at both ends and is slidable along the lower end of the presser bar, the plate being disposed between the sleeve and the lower end of the bar; and a member which extends through the sleeve and plate into the recess in a position between the spring and the recess wall. The spring normally presses against the member to hold the plate in its lower position, covering the exposed the side of the slot. The plate can be raised to uncover the slot, by applying manual pressure to overcome the force of the spring, and when the manual pressure is removed, the spring will force the member downward and move the plate back into its lower position to cover the slot.

In order to install the foot, the sleeve is raised until the slot is exposed; the cross pin of the device is placed in the slot; and the pressure on the sleeve is released, whereby the sleeve is lowered and the plate covers the slot to lock the pressure foot device in position.. In order to remove the device, the sleeve must be raised until the slot is exposed; the cross pin of the device is removed from the slot, and the pressure on the sleeve is again released and the plate covers the slot until a pressure foot device is again installed.

DETAILED DESCRIPTION OF PREFERRED EMBODIMENTS

Figure 1:
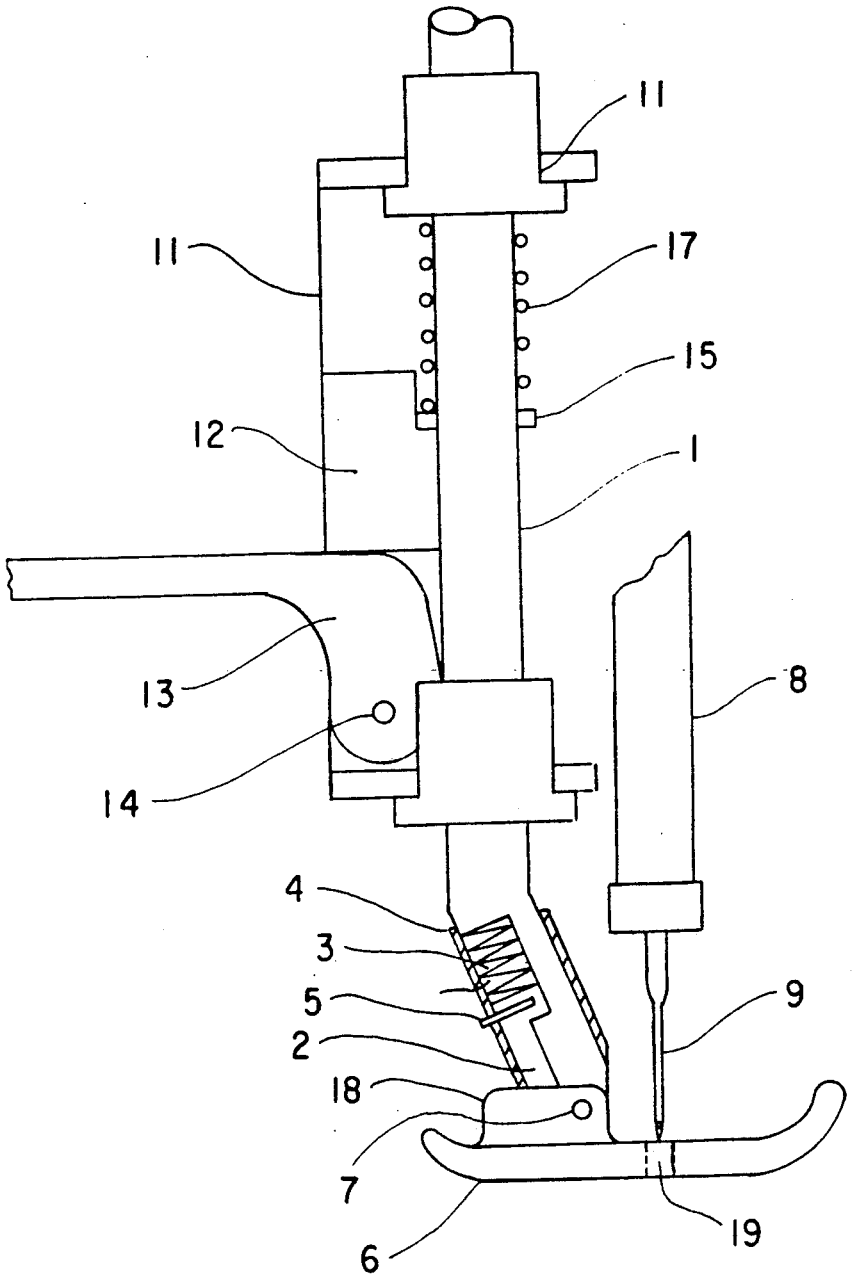
FIG. 1 is a side view in cross section of a preferred embodiment of the invention showing the presser foot device secured to the presser bar in position for use.
Figure 3:
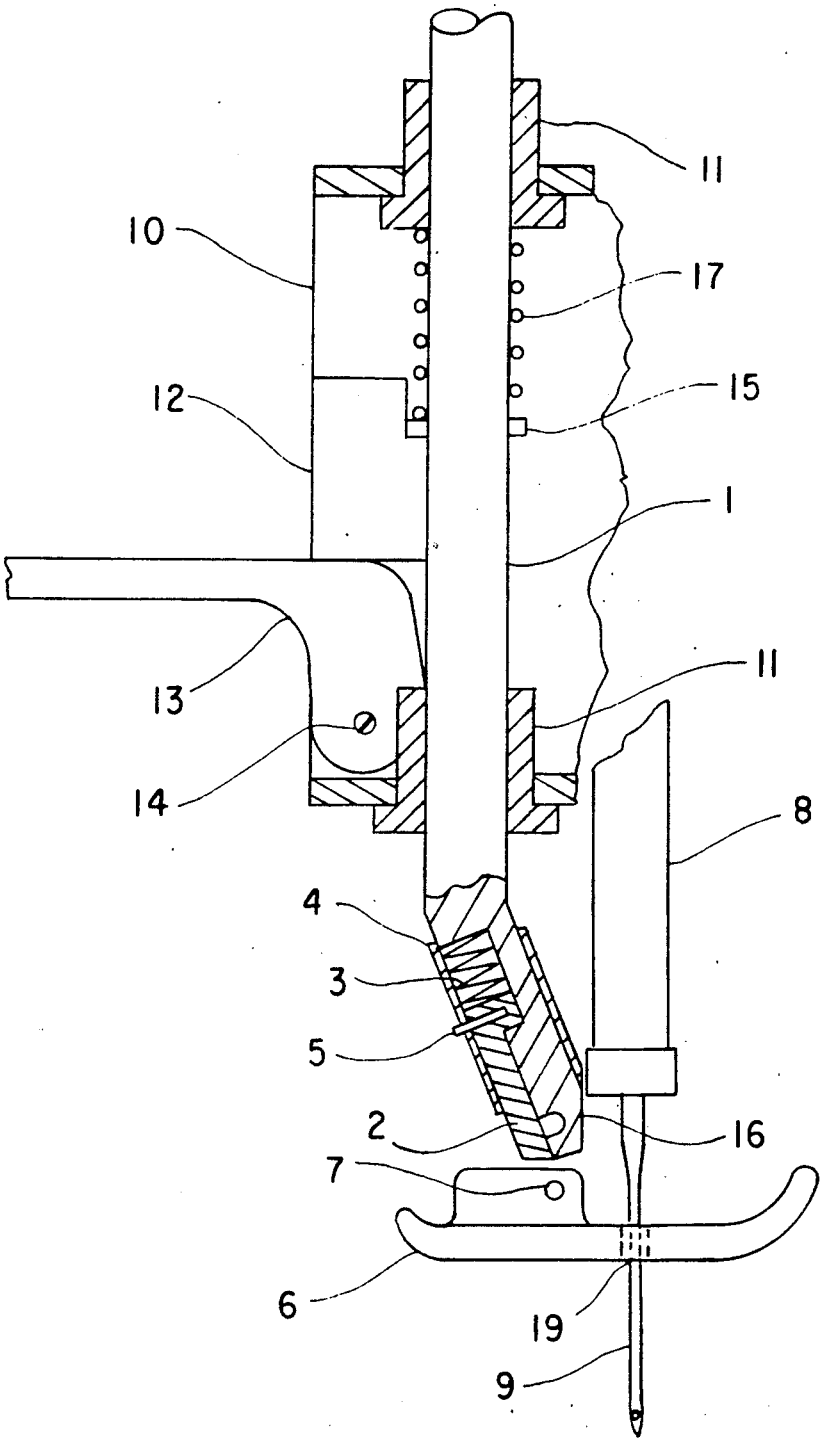
FIG. 3 is view similiar to FIG. 1 but showing the presser foot device detached from the presser bar.
Figure 2:
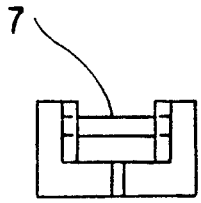
FIG. 2 is a detail cross section of the presser foot device taken at right angles to the view of the device shown in FIG. 1.
Figure 4:
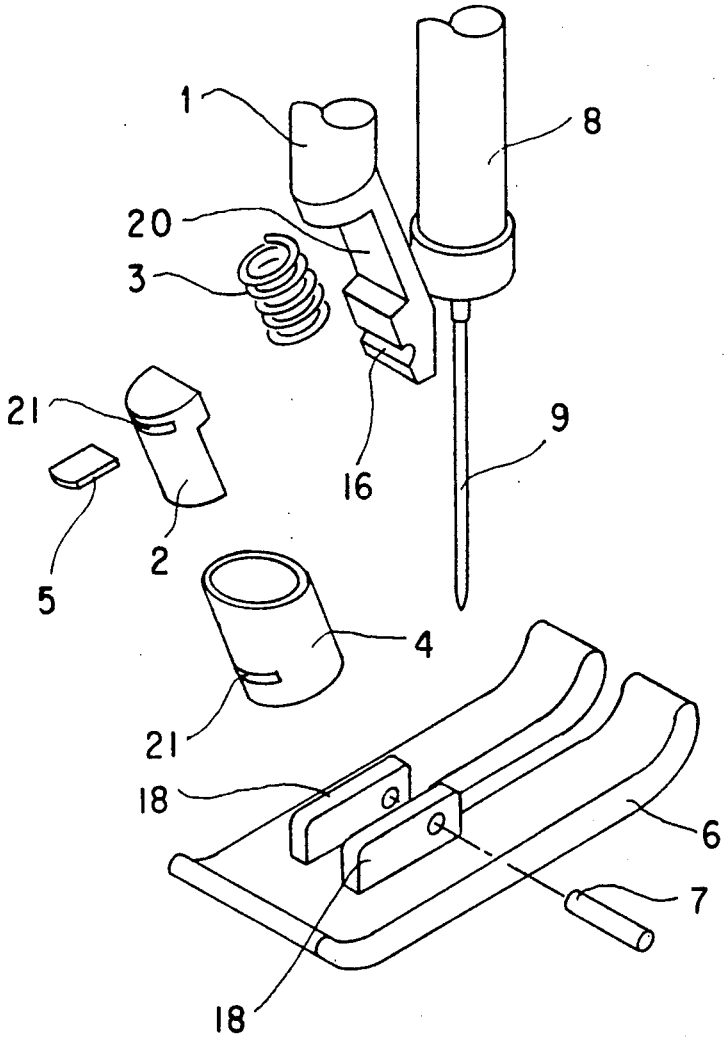
FIGS. 4, 5 and 6 are different detail and exploded views of the lower end of the presser bar and associated components.
Figure 5:
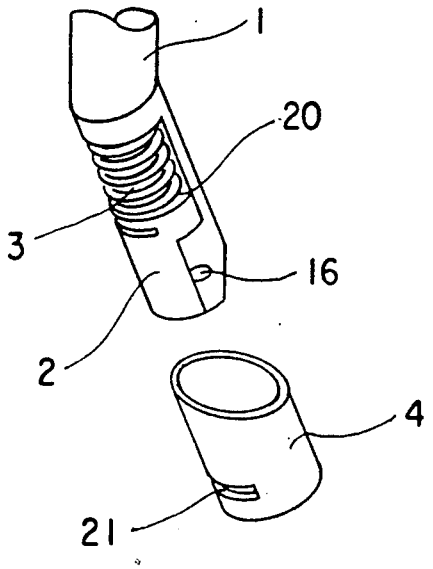
Figure 6:
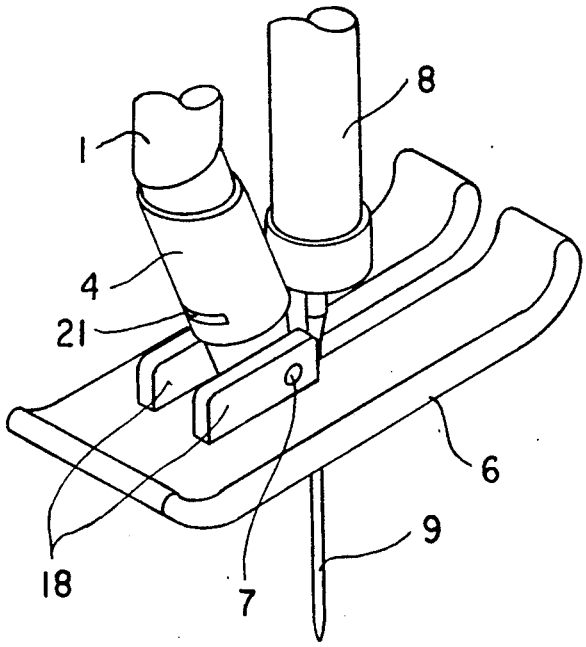

The presser foot retainer system shown in FIGS. 1-6 utilizes the various components identified by number as set forth in the table below.

TABLE

| | |
|---|---|
| presser bar | 1 |
| slide plate | 2 |
| compression spring | 3 |
| cover sleeve | 4 |
| connector pin | 5 |
| presser foot | 6 |
| cross pin | 7 |
| needle bar | 8 |
| needle | 9 |
| mounting plate | 10 |
| bushings | 11 |
| guide bar | 12 |
| lever | 13 |
| rivet | 14 |
| washer | 15 |
| slot | 16 |
| compression spring | 17 |
| cross pin - presser foot connector | 18 |
| needle receiving bore | 19 |
| recess | 20 |

Referring now to FIGS. 1-4, the lower portion of presser bar 1 is inclined. The bar 1 adjacent its lower end is provided with a horizontal slot 16 which extends completely through the bar. One side of the slot is exposed by one inclined surface of the lower end of the bar. The lower end of the bar also is provided with a recess 20 which has an opening exposed by the same inclined surface. Compression spring 3 is fitted into the recess 20. The axis of the spring is aligned with the line of elongation of the lower end of the bar. A slide plate 2 is slidable along the exposed surface of the lower end of the bar between a raised position at which the slot is exposed and a lowered position at which the slot is covered. A hollow sleeve 4 extends around the outer surface of the lower end of the bar and is slidable up and down therealong. The plate 2 is held between the sleeve and the exposed surface of the bar. The plate and sleeve have aligned holes 21 through which a horizontal connector pin 5 extends. The pin extends into the recess and is wedged between the lower end of the spring and the adjacent wall of the recess.

Normally the spring holds the pin 5 in such position that the plate 2 covers the slot 16. As explained previously, when an operator pushes the sleeve upwardly against the pressure of the spring, the plate is moved upward to expose the slot. When the operator releases the sleeve, the spring will push the pin 5 downwardly and the plate will be moved downward to cover the slot.

During installation, the spring is first fitted into the recess. The plate is moved into position. The cover sleeve 4 is slid around the bar 1 and over the outer surface of plate 2 and over spring 3 until the holes in the sleeve and plate are aligned. Connector pin 5 is then inserted as described.

Upper and lower bushings 11 are fitted to the mounting plate 10, followed by lever 13 and securing rivet 14. Bar 1 is inserted through the bushings with compression spring 17 surrounding the portion of bar 1 between the upper bushing and washer 15. Guide bar 12 is attached.

The presser foot device includes an elongated generally horizontal foot 6 with a vertical connector 18 secured to the upper surface of the foot along the center line of elongation. The upper portion of connector 18 defines a yoke in which is inserted a horizontal cross pin 7. Pin 7 extends at right angles to the direction of elongation. The device can be installed or removed as previously described with pin 7 being locked in position in the slot 16 by plate 2 when the device is installed.

The bar 1 is inclined downwardly toward the needle bar 8 and the needle 9. Foot 6 has a vertical bore 19 through which the needle can extend during sewing.

While the invention has been described with particular reference to the drawings and to the preferred embodiment, the protection sought is to be limited only by the terms which follow.

What is claimed is:

1. A presser foot retainer system for use in a sewing machine, said system comprising:

a presser foot device including an elongated generally horizontal foot, a horizontal cross pin positioned above the foot and extending in a direction generally at right angles to the direction of elongation of the foot, and a first means connected to the pin and the foot to support the pin in said position;

a presser bar having upper and lower ends, the bar having an exterior surface and a slot adjacent to the lower end of the bar, said slot being generally parallel with the pin and having an opening flush with said exterior surface for accommodating the pin; and a second means disposed at the lower end of the bar and cooperating with the slot and the pin to enable the pin to be detachably engaged in the slot to detachably secure the device to the bar, said second means including a plate slidable on and along the surface between a first position at which the opening of the slot is exposed and a second position at which the opening of the slot is covered.

2. The system of claim 1 wherein the means includes a spring biasing arrangement which normally places the plate in the second position, said arrangement responding to the application of suitable pressure thereon to place the plate in the first position and returning the plate to the second position when the pressure is removed, the cross pin being inserted in the slot when the plate is thereafter returned to the second position.

3. The system of claim 2 wherein the bar contains a recess disposed between the upper end of the bar and the slot adjacent the slot, the spring arrangement including a compression spring disposed in the slot.

4. The system of claim 3 wherein the presser bar is generally vertical but having said lower end inclined downwardly, the axis of the spring being aligned with the direction of inclination.

5. The system of claim 4 wherein the means further includes a hollow sleeve through which the lower end of the bar extends, the plate being disposed between the sleeve and the bar, the sleeve being slidable along the lower end of the bar.

6. The system of claim 5 wherein the means also includes a member extending through the sleeve and the plate into the recess between the lower end of the spring and the adjacent wall of the recess.

* * * * *